US006957878B2

(12) United States Patent
Greenwald et al.

(10) Patent No.: US 6,957,878 B2
(45) **Date of Patent: *Oct. 25, 2005**

(54) LATCH MOVER FOR QUICK-MOUNT TELESCOPING SLIDE SUPPORT SYSTEM

(75) Inventors: William B. Greenwald, Beech Grove, IN (US); Jeff L. Naue, New Palestine, IN (US)

(73) Assignee: General Devices Co., Inc., Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/788,100

(22) Filed: Feb. 26, 2004

(65) Prior Publication Data

US 2005/0189856 A1 Sep. 1, 2005

(51) Int. Cl.[7] ..... A47B 88/00
(52) U.S. Cl. ..... 312/334.4; 312/223.1
(58) Field of Search ..... 312/334.4, 334.5, 312/330.1, 265.1, 265.4, 223.1, 334.7, 350; 211/26; 384/22; 361/725, 727

(56) References Cited

U.S. PATENT DOCUMENTS

| | | | |
|---|---|---|---|
| 0,516,583 | A | 3/1894 | Adkins |
| 1,698,252 | A | 1/1929 | Ashe |
| 2,644,588 | A | 7/1953 | Brown |
| 2,749,200 | A | 6/1956 | Kuss |
| 2,809,086 | A | 10/1957 | Fall |
| 3,054,511 | A | 9/1962 | Erismann |
| 3,133,768 | A | 5/1964 | Klakovich |
| 3,601,432 | A | 8/1971 | Fenwick et al. |
| 4,049,230 | A | 9/1977 | Minniear |
| 4,106,738 | A | 8/1978 | Kostecky |
| 4,423,914 | A | 1/1984 | Vander Ley |
| 4,441,722 | A | 4/1984 | Pichler |
| 4,441,772 | A | 4/1984 | Fielding et al. |
| 4,474,492 | A | 10/1984 | Fleitas |
| 5,063,715 | A | 11/1991 | Goodman |
| 5,199,777 | A | 4/1993 | Taima et al. |
| 5,292,198 | A | 3/1994 | Rock et al. |
| 5,405,195 | A | 4/1995 | Hobbs |
| 5,433,517 | A | 7/1995 | Fleisch |
| 5,580,138 | A | 12/1996 | Grabher |
| 5,620,244 | A | 4/1997 | Yang |
| 5,632,542 | A | 5/1997 | Krivec |
| 5,671,988 | A | 9/1997 | ONeil |
| 5,683,159 | A | 11/1997 | Johnson |
| 5,730,514 | A | 3/1998 | Hashemi |
| 5,823,648 | A | 10/1998 | Domenig |
| 5,904,412 | A | 5/1999 | Lammens |
| 6,027,194 | A | 2/2000 | Fleisch |
| 6,209,979 | B1 | 4/2001 | Fall et al. |
| 6,273,534 | B1 | 8/2001 | Bueley et al. |
| 6,422,399 | B1 | 7/2002 | Castillo et al. |
| 6,749,275 | B2 * | 6/2004 | Cutler et al. ..... 312/334.4 |
| 2004/0089779 | A1 * | 5/2004 | Greenwald et al. ..... 248/241 |
| 2004/0094492 | A1 * | 5/2004 | Greenwald et al. ..... 211/26 |

* cited by examiner

FOREIGN PATENT DOCUMENTS

| | | |
|---|---|---|
| CA | 817754 | 7/1969 |

*Primary Examiner*—Janet M. Wilkens
(74) *Attorney, Agent, or Firm*—Barnes & Thornburg LLP

(57) ABSTRACT

A telescoping slide support assembly includes a telescoping slide assembly, a vertical rack for use in an equipment cabinet, and a quick-mount support coupled to a stationary slide included in the telescoping slide assembly. The quick-mount support includes a movable latch and a linkage for moving the movable latch about a pivot axis to facilitate coupling and uncoupling of the quick-mount support and the vertical rack.

30 Claims, 6 Drawing Sheets

LATCH MOVER FOR QUICK-MOUNT TELESCOPING SLIDE SUPPORT SYSTEM

BACKGROUND

The present disclosure relates to telescoping slide assemblies, and particularly to telescoping slide assemblies mounted on racks to support a piece of equipment for movement relative to the rack. More particularly, the present disclosure relates to bracket systems for mounting telescoping slide assemblies on racks included in an equipment cabinet.

SUMMARY

A telescoping slide assembly support system in accordance with the present disclosure includes a telescoping slide assembly, a vertical rack for use in an equipment cabinet, and a quick-mount support coupled to a stationary slide included in the telescoping slide assembly. The quick-mount support is configured to be coupled quickly and easily to the rack to facilitate mounting the stationary slide in a fixed position relative to the rack. A load-carrying slide also included in the telescoping slide assembly can be coupled to a piece of equipment to support that equipment for movement relative to the rack into and out of the equipment cabinet.

In illustrative embodiments of the present disclosure, the quick-mount support includes bottom and top latches pivotably coupled to a mount unit and sized to extend through latch apertures formed in the rack when the quick-mount support is coupled to the rack. The bottom and top latches can be pivoted toward one another to assume a drawn-together position so that the latches are aligned to extend through two of the latch apertures formed in the rack as a technician moves the quick-mount support toward engagement with the rack during the coupling process.

A latch mover included in the quick-mount support can be moved by a technician in a first direction to spread the pivotable bottom and top latches apart to assume a spread-apart position and cause latch lugs included in the bottom and top latches to move to confront the rack so that uncoupling of the quick-mount support and the rack is blocked. The latch mover can also be moved by a technician in an opposite, second direction to allow the bottom and top latches to be pivoted toward one another to assume the drawn-together position so that the latch lugs on the latches can be removed from the latch apertures formed in the rack during uncoupling of the quick-mount support and the rack.

Features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
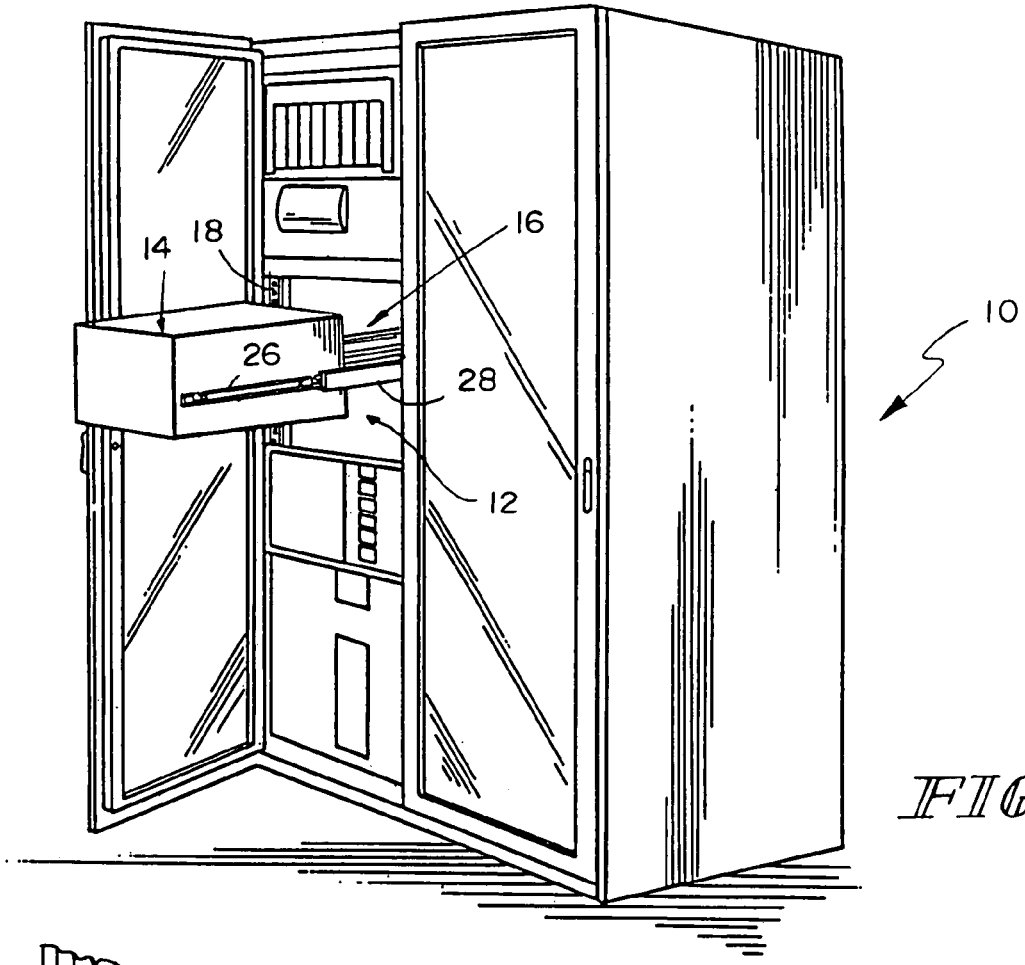
FIG. 1 is a perspective view showing a piece of equipment mounted on two fully extended telescoping slide assemblies that are mounted on vertical racks provided inside a cabinet to enable a technician to move the piece of equipment easily into and out of the cabinet.
Figure 2:
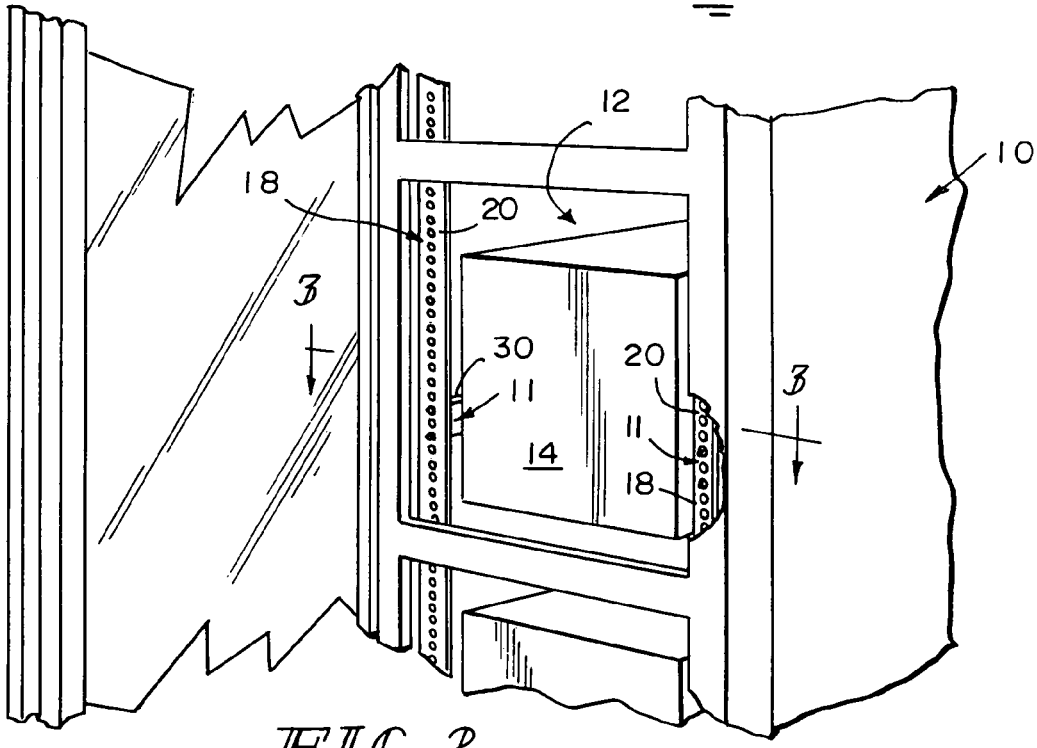
FIG. 2 is a partial perspective view of the cabinet of FIG. 1, with portions broken away, showing the piece of equipment located inside the cabinet owing to the full retraction of the telescoping slide assemblies inside the cabinet and showing two forward vertical racks and a series of latch apertures formed in each of the forward vertical racks wherein two latches associated with a quick-mount support coupled to a "left-side" slide assembly extend into two of the latch apertures formed in a left-side forward vertical rack and two latches associated with a quick-mount support coupled to a "right-side" slide assembly extend into two of the latch apertures formed in a right-side forward vertical rack.

An equipment cabinet 10 includes an interior region 12 adapted to store equipment therein as shown, for example, in FIGS. 1 and 2. A piece of equipment 14 is mounted on a pair of spaced-apart telescoping slide assemblies 16 for movement thereon between a fully extended position away from cabinet 10 as shown in FIG. 1 and a fully retracted position within cabinet 10 as shown in FIG. 2. Vertical racks 18 are mounted in cabinet 10 as shown, for example, in FIGS. 1–3 and telescoping slide assemblies 16 are mounted to these vertical racks 18 using a quick-mount support system disclosed herein and shown, for example, in FIGS. 4–15.

Each vertical rack 18 includes a forwardly facing surface 20, a rearwardly facing surface 22, and a series of latch apertures 23, 24, 25, etc., as shown, for example, in FIGS. 4 and 10–15. Each vertical rack 18 is coupled to equipment cabinet 10 and positioned to lie in the interior region 12 as shown, for example, in FIG. 3. It is within the scope of this disclosure to configure and orient rack 18 to support slide assemblies in a wide variety of locations within cabinet 10. In many instances, rack 18 will have a "vertical" orientation but other orientations fall within the scope of this disclosure.

Telescoping slide assembly 16 includes any suitable number of slides. In the illustrations, telescoping slide assembly 16 includes interconnected load-carrying slide 26, intermediate slide 28, and stationary slide 30. These slides 26, 28, and 30 are movable relative to one another to extend and retract load-carrying slide 26 relative to stationary slide 30 between fully extended and retracted positions as suggested in FIGS. 1 and 2. Piece of equipment 14 is coupled to spaced-apart load-carrying slides 26 in any suitable manner as shown, for example, in FIG. 3. It is within the scope of this disclosure to omit intermediate slide 28 or add additional intermediate slides (not shown).

Figure 10:
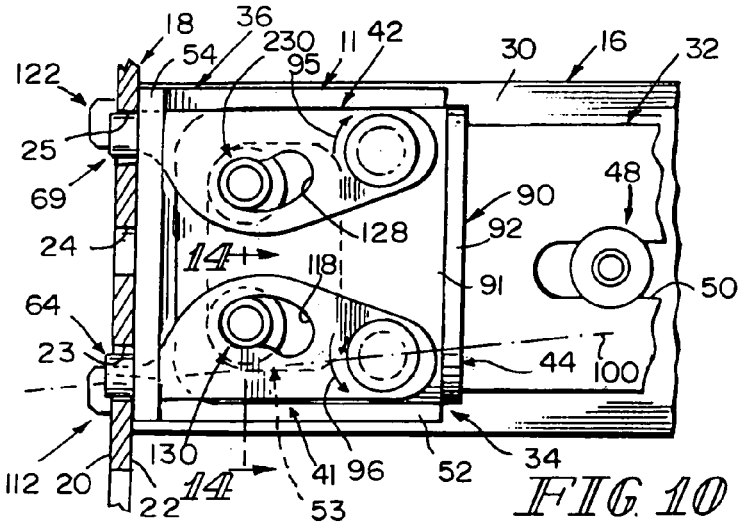
FIG. 10 is a sectional view similar to FIGS. 8 and 9 showing the quick-mount support anchored to the vertical rack in the locked configuration after movement of the pin slider carrying the first and second drive pins toward the vertical rack (1) to move the first drive pin into the left lobe channel formed in the bottom latch to pivot the bottom latch to a "lowered and locked" position and (2) to move the second drive pin into the left lobe channel formed in the top latch to pivot the top latch to a "raised and locked" position to cause the stationary slide of the telescoping slide assembly to be held in a fixed position relative to the vertical rack provided in the cabinet as shown in FIGS. 2 and 3.

A pair of quick-mount supports 11 is provided so that each end of each stationary slide 30 can be mounted to an adjacent vertical rack 18 quickly and easily. Thus, the telescoping slide assemblies 16 used to support equipment 14 are positioned to lie in spaced-apart parallel relation to one another in fixed positions on vertical racks 18. Quick-mount support 11 can be operated quickly and easily by a technician provided with access to interior region 12 of equipment cabinet 10 to couple quick-mount support 11 to vertical rack 18 as shown in FIG. 10.

Figure 7:
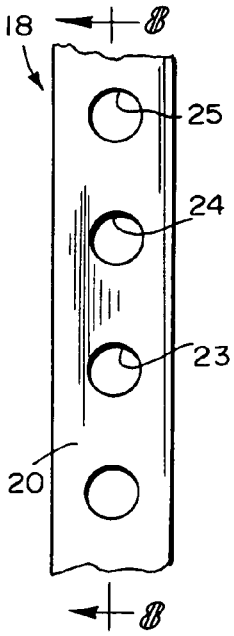
FIG. 7 is an elevation view of the vertical rack shown in FIG. 4 showing a "perforated" front wall formed to include four latch apertures.
Figure 8:
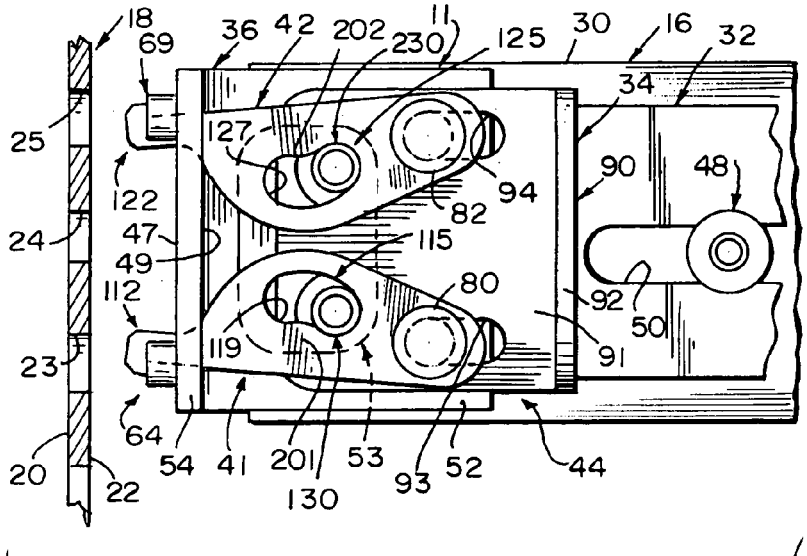
FIG. 8 is a sectional view taken along line 8—8 of FIG. 7 and showing the quick-mount support of FIGS. 4–6 in the unlocked configuration before it is coupled to the perforated front wall of the vertical rack and showing "raising" of the pivotable bottom latch and "lowering" of the pivotable top latch to locate the bottom and top latches in the drawn-together position by moving a pin slider carrying the first and second drive pins therein away from the vertical rack so that each of those latches is poised to pass into one of the latch apertures formed in the front wall of the vertical rack.
Figure 9:
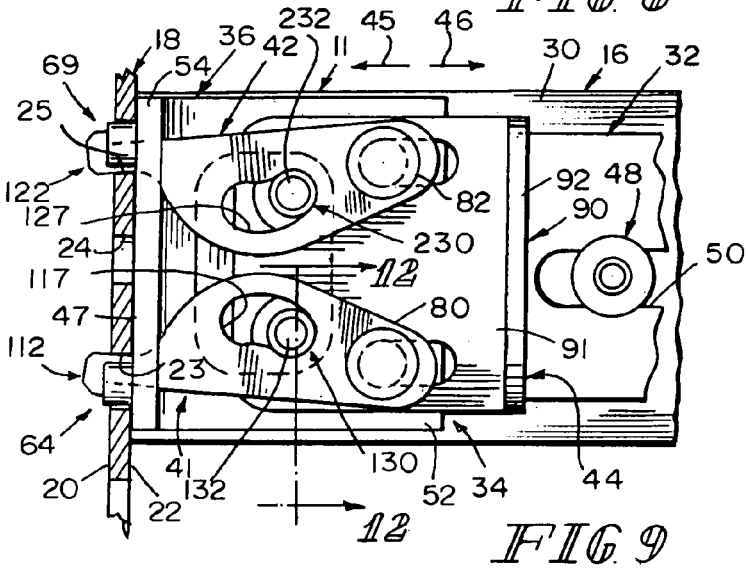
FIG. 9 is a sectional view similar to FIG. 8 showing movement of a rack mount included in the quick-mount support to engage the perforated front wall of the vertical rack and to extend the raised bottom latch into one of the latch apertures formed in the front wall and to extend the lowered top latch into another of the latch apertures.

Quick-mount support 11 includes a slide support bracket 32 coupled to stationary slide 30 and a retainer mechanism 34 coupled to slide support bracket 32 and configured to mate easily to vertical rack 18 so that quick-mount support 11 can be coupled to and uncoupled from vertical rack 18 quickly and easily in a manner suggested in FIGS. 7–9. Fasteners 48 can be arranged to extend through apertures or position-adjustment slot 50 formed in slide support bracket 32 to engage stationary slide 30 so that slide support bracket 32 is mounted in a fixed position on one end of stationary slide 30.

Figure 4:
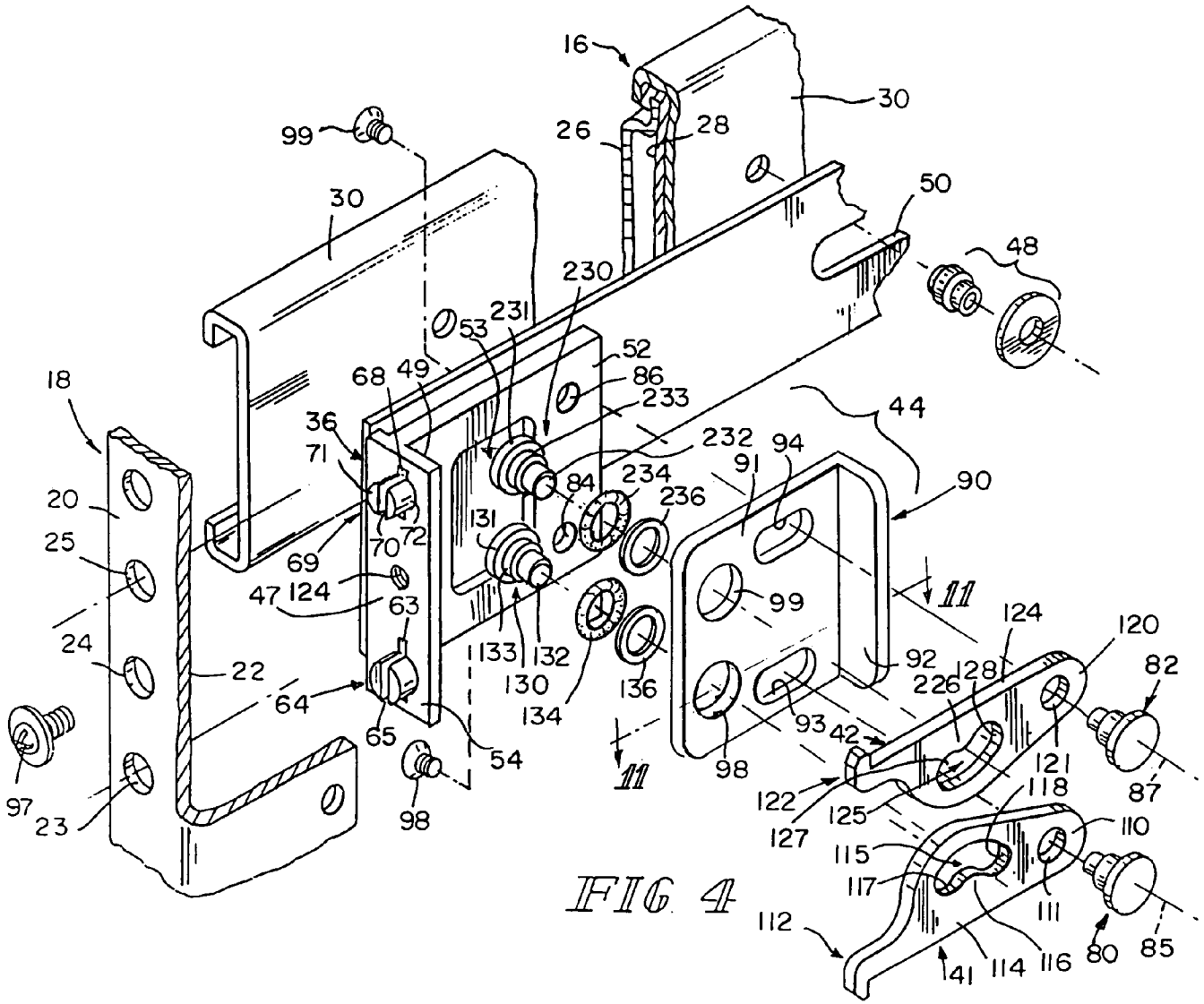
FIG. 4 is an enlarged perspective assembly view of various components that can be assembled as shown, for example, in FIG. 5, to produce a quick-mount support in accordance with an illustrative embodiment of this disclosure.
Figure 14:
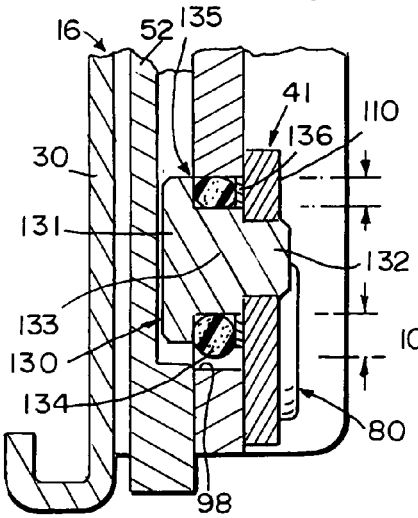
FIG. 14 is a sectional view taken along line 14—14 of FIG. 10 showing the ring-shaped first drive pin retainer in a "compressed" state.
Figure 15:
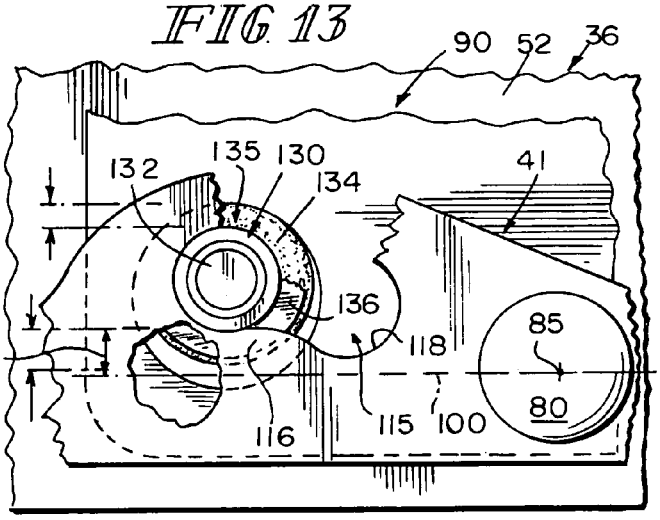
FIG. 15 is an enlarged view of a portion of the bottom latch located in the lowered and locked (spread-apart) position shown in FIGS. 10 and 14.

As suggested in FIGS. 4, 14, and 15, quick-mount support 11 further includes a connector 97 arranged to pass through aligned apertures 24, 124 formed, respectively, in each of rack 18 and rack mount 54. Fasteners 98 and 99 can be used to couple retainer mount 52 to slide support bracket 32 as also suggested in FIG. 4.

Retainer mechanism 34 includes a mount unit 36, a bottom latch 41, and a top latch 42 as shown best in FIG. 4. It is within the scope of this disclosure to couple latches 41, 42 to mount unit 36 to pivot, slide, or otherwise move relative to mount unit 36 during coupling and uncoupling of quick-mount support 11 and rack 18.

Figure 5:
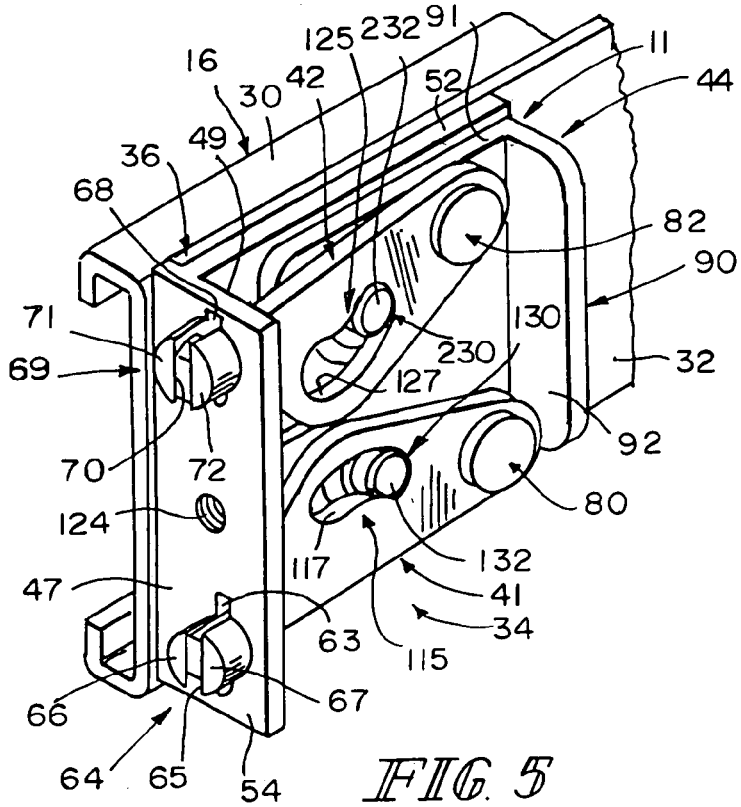
FIG. 5 is an enlarged perspective view of the quick-mount support of FIG. 4 in an "unlocked" configuration (as seen in FIGS. 8 and 9) after it has been assembled and mounted on one end of a stationary slide included in the three-part telescoping slide assembly and showing pivotable top and bottom pivotable latches maintained in a "drawn-together" position, each latch having a latch lug extending through a slot formed in a mount unit and a channel formed in a split-cylinder alignment guide, the pivotable bottom latch being urged to a "raised and unlocked" position by placement of a first drive pin in a right lobe channel provided in an arcuate slot formed in the bottom latch, and the pivotable top latch being urged to a "lowered and unlocked" position by placement of a second drive pin in a right lobe channel provided in an arcuate slot formed in the top latch.

Mount unit 36 includes a latch mount 52 coupled to slide support bracket 32 and a rack mount 54 arranged to lie at a right angle to latch mount 52 as shown, for example, in FIGS. 4 and 5. In the illustrated embodiment, latch mount 52 is established by a first metal plate welded or otherwise secured to a second metal plate establishing the rack mount 52. It is within the scope of this disclosure to form mount unit 36 of a monolithic metal or plastics material.

Figure 3:
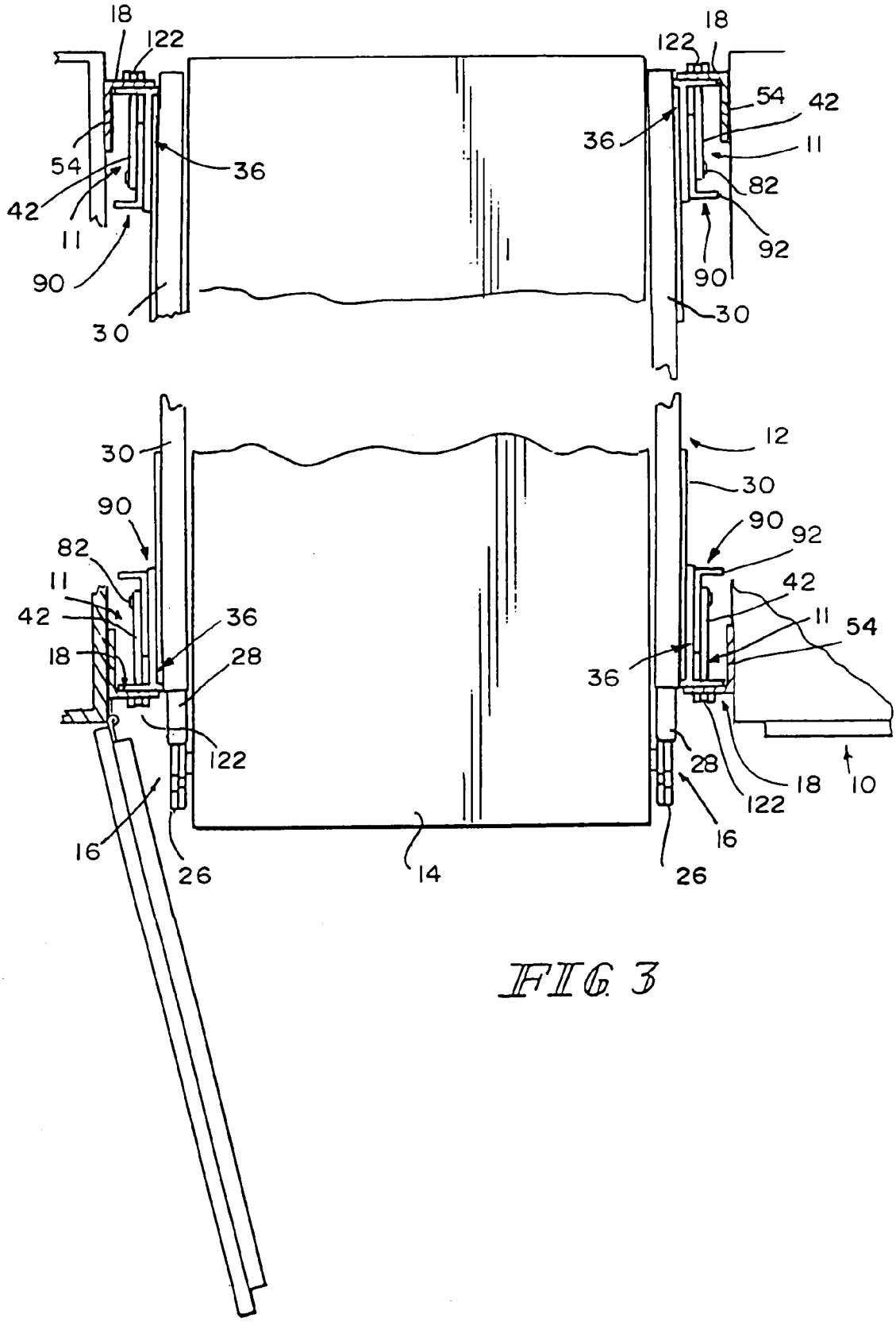
FIG. 3 is a sectional view taken along line 3—3 of FIG. 2 after the piece of equipment has been moved on the telescoping slide assemblies a short distance out of the cabinet showing a pair of spaced-apart three-part telescoping slide assemblies, a piece of equipment mounted there between, and four quick-mount supports and showing that each quick-mount support is coupled to one of the forward and rearward vertical racks and to a nearby portion of one of the telescoping slide assemblies to anchor the slide assemblies to the vertical racks.

Rack mount 54 is adapted to mate with rack 18 when quick-mount support 11 is coupled to rack 18 as suggested in FIGS. 3, 9, and 10. Rack mount 54 includes a forwardly facing surface 47 and a rearwardly facing surface 49. Forwardly facing surface 47 of rack mount 54 is arranged to lie in mating relation to rearwardly facing surface 22 of rack 18 to align latch apertures formed in rack 18 with various latch-receiving slots and channels formed in rack mount 54 as suggested in FIGS. 4 and 10. It is within the scope of this disclosure to place an intervening element between rack mount 54 and rack 18 so long as both of the movable latches 41, 42 are able to extend through and move in companion latch-receiving slots and channels formed in rack mount 54 and latch apertures formed in rack 18.

As suggested in FIG. 4, rack mount 54 of mount unit 36 is formed to include first and second slots 63, 68, a first alignment guide 64 associated with first slot 63, and a second alignment guide 69 associated with second slot 68. Alignment guides 64, 69 are used to orient quick-mount support 11 (and particularly rack mount 54) in a predetermined position relative to rack 18 as suggested in FIGS. 3, 9, and 10 to facilitate coupling of the quick-mount support 11 to the rack 18.

First alignment guide 64 is coupled to rack mount 54 of mount unit 36 and formed to include a first channel 65 communicating with first slot 63 in rack mount 54. In the illustrated embodiment, first alignment guide 64 comprises a pair of first tabs 66, 67 arranged to form first channel 65 therebetween. Second alignment guide 69 is coupled to rack mount 54 of mount unit 36 and formed to include a second channel 70 communicating with second slot 68 in rack mount 54. Also in the illustrated embodiment, second alignment guide 69 comprises a pair of second tabs 71, 72 arranged to form second channel 70 therebetween. Also in the illustrated embodiment, each of first tabs 66, 67 and second tabs 71, 72 has a partial cylindrical shape with an outwardly presented curved exterior surface and an inwardly presented flat interior surface. Pairs of tabs having such a shape cooperate to define a "split-cylinder" alignment guide. It is within the scope of this disclosure to vary the shape and number of tabs in each alignment guide.

As suggested in FIGS. 4 and 6–8, first alignment guide 64 is arranged to extend through latch aperture 23 formed in rack 18 and second alignment guide 69 is arranged to extend through latch aperture 25 formed in rack 18 so that rack mount 54 is oriented properly with respect to rack 18 to allow latches 41, 42 to extend into the slots and channels formed in rack mount 54 and latch apertures formed in rack 18. The outwardly presented curved exterior surfaces of first tabs 66, 67 fit into and mate with a circular inner edge of latch aperture 23. Likewise, the outwardly presented curved exterior surfaces of second tabs 71, 72 fit into and mate with a circular inner edge of latch aperture 25.

Figure 11:
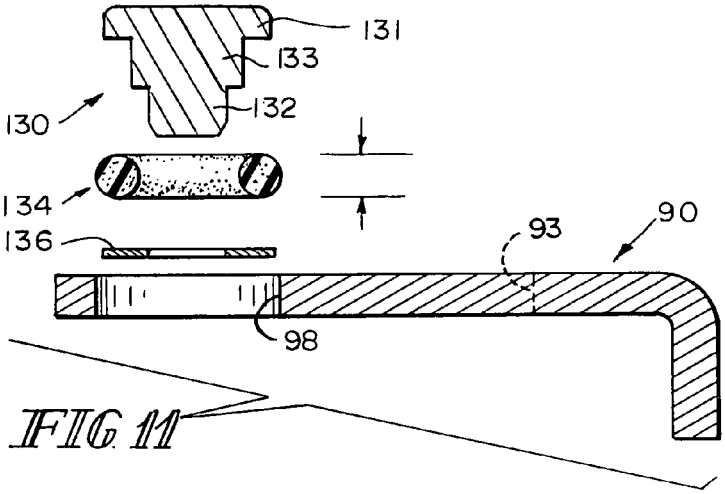
FIG. 11 is an enlarged sectional view of the pin slider taken along line 11—11 of FIG. 4 and showing a slide plate formed to include a first aperture (in solid) and a guide slot (in phantom) and a push tab coupled to a right end of the slide plate and showing the first drive pin along with a ring-shaped first drive pin retainer and a first washer before those components are mounted in the first aperture formed in the slide plate as suggested in FIGS. 12 and 13.
Figure 12:
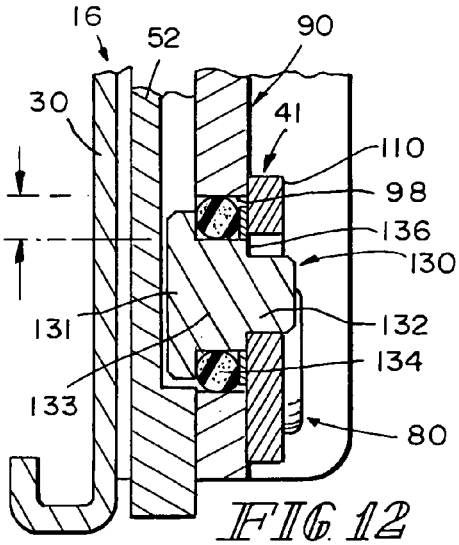
FIG. 12 is a sectional view taken along line 12—12 of FIG. 9 showing the ring-shaped first drive pin retainer in an "uncompressed" state.
Figure 13:
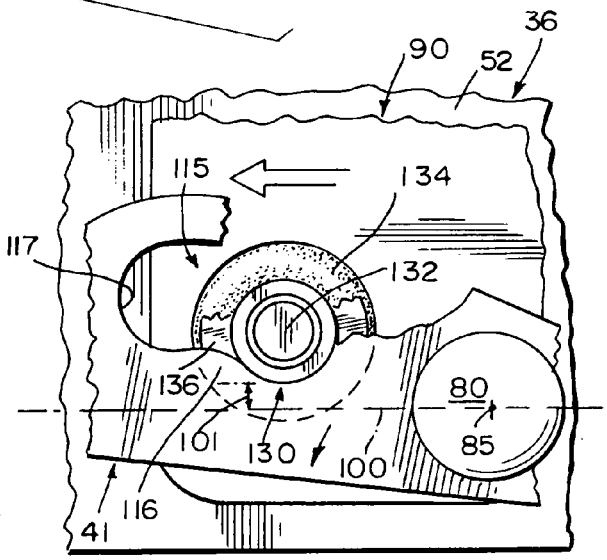
FIG. 13 is an enlarged view of a portion of the bottom latch located in the raised and unlocked (drawn-together) position shown in FIGS. 9 and 12.

By inserting these alignment guides 64, 69 into two of the latch apertures (e.g., 23 and 25) formed in vertical rack 18, it is a simple matter for a technician to orient quick-mount support 11 on stationary slide 30 with rack 18 so that tips of movable latches 41, 42 are aligned and can be mated with rack 18 as suggested, for example, in FIGS. 11, 13, and 15 to "anchor" stationary slide 30.

Figure 6:
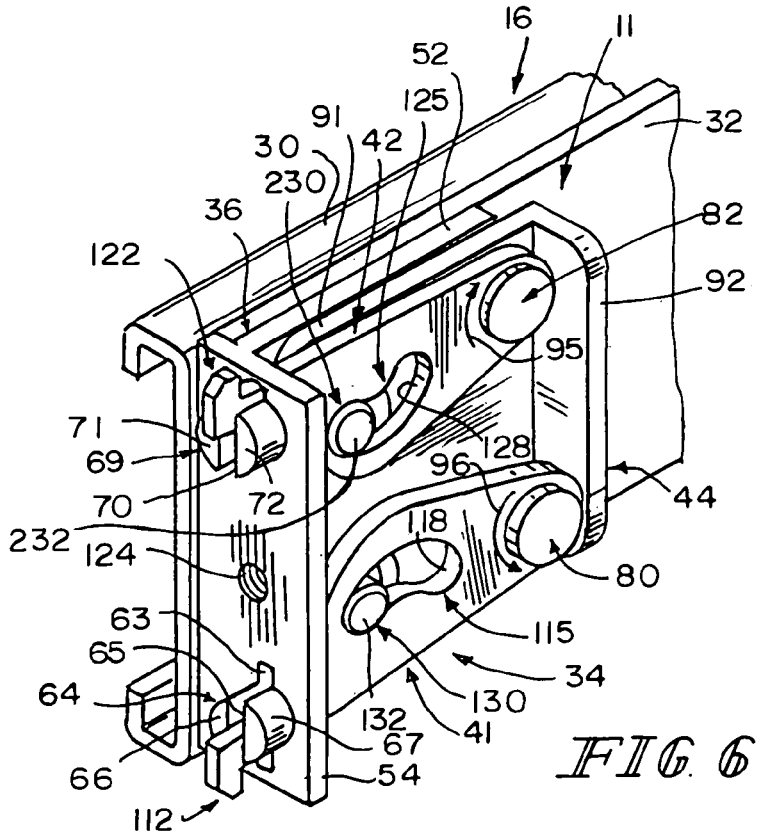
FIG. 6 is a perspective view similar to FIG. 5 of the quick-mount support in a "locked" configuration (as seen in FIG. 10) showing pivotable movement of the top and bottom latches away from one another to assume a "spread-apart" position upon movement of the first and second drive pins to left lobe channels provided in the arcuate slots formed in the bottom and top latches.

A "tip" 112 of bottom latch 41 (shown in FIG. 4) extends through first slot 63 and first channel 65 associated with first alignment guide 64 and is movable therein from a first position as shown in FIGS. 5, 8, and 9 to a second position as shown in FIGS. 6 and 10. Likewise, a "tip" 122 of top latch 42 (also shown in FIG. 4) extends through second slot 68 and second channel 70 associated with second alignment guide 69 and is movable therein from a first position as shown in FIGS. 5, 8, and 9 to a second position as shown in FIGS. 6 and 10. Thus, movable bottom latch 41 is arranged to extend through a first (23) of the latch apertures formed in rack 18 and movable top latch 42 is arranged to extend through a second (25) of the latch apertures formed in rack 18 as suggested in FIGS. 9 and 10.

As suggested in FIGS. 4 and 5, a first pivot mount 80 is associated with pivotable bottom latch 41 and a second pivot mount 82 is associated with pivotable top latch 42. First pivot mount 80 extends into a first mount aperture 84 formed in retainer mount 52 to support bottom latch 41 for up and down pivotable movement about first pivot axis 85. Second pivot mount 82 extends into a second mount aperture 86 formed in retainer mount 52 to support top latch 42 for up and down pivotable movement about second pivot axis 87.

As suggested in FIGS. 4 and 8, bottom latch 41 includes a base 110 intersecting first latch pivot axis 85 and providing an aperture 111 receiving a neck of first pivot mount 80, a latch lug 112 arranged to extend through the first (23) of the latch apertures formed in rack 18, and a mid-section 114 arranged to interconnect base 110 and latch lug 112 of bottom latch 41. Top latch 42 includes a base 120 intersecting second latch pivot axis 87 and providing an aperture 121 receiving a neck of second pivot mount 82, a latch lug 122 arranged to extend through the second (25) of the latch apertures formed in rack 18, and a mid-section 124 arranged to interconnect base 120 and latch lug 122 of top latch 42.

Means is provided for selectively pivoting bottom and top latches 41, 42 about first and second pivot axes 85, 87 (1) away from one another to assume a spread-apart position to mate bottom and top latches 41, 42 with rack 18 as shown, for example, in FIG. 10, to block uncoupling of quick-mount support 11 and rack 18 and (2) toward one another to assume a drawn-together position to unmate bottom and top latches 41, 42 away from rack 18 as suggested, for example, in FIG. 9, to allow uncoupling of quick-mount support 11 and rack 18. Bottom latch 41 is configured to include an arcuate first drive pin receiver (e.g., 115) and top latch 42 is configured to include an arcuate second drive pin receiver (e.g., 125). A latch mover 44 includes a first drive pin 130 arranged to move relative to bottom latch 41 in arcuate first drive pin receiver 115, a second drive pin 230 arranged to move relative to top latch 42 in arcuate second drive pin receiver 125, and a pin slider 90. First and second drive pins 130, 230 are coupled to pin slider 90 to move therewith relative to bottom and top latches 41, 42.

Pin slider 90 is mounted to move relative to bottom and top latches 41, 42 to cause first drive pin 130 to move in arcuate first drive pin receiver 115 and to cause second drive pin 230 to move in arcuate second drive pin receiver 125 between (1) latch-locking positions wherein first and second drive pins 130, 230 move bottom and top latches 41, 42 away from one another to a spread-apart position to mate bottom and top latches 41, 42 with rack 18 to block uncoupling of quick-mount support 11 and rack 18 and (2) latch-releasing positions wherein first and second drive pins 130, 230 move bottom and top latches 41, 42 toward one another to a drawn-together position to unmate bottom and top latches 41, 42 from rack 18 to allow uncoupling of quick-mount support 11 and rack 18.

First drive pin 130 includes a large-diameter pin head 131 at one end, a narrow-diameter drive tip 132 at an opposite end, and an intermediate-diameter neck 133 interconnecting pin head 131 and drive tip 132 as shown in FIGS. 4 and 11. Second drive pin 230 includes a large-diameter pin head 231 at one end, a narrow-diameter drive tip 232 at an opposite end, and an intermediate-diameter neck 233 interconnecting pin head 231 and drive tip 132 as shown in FIG. 4.

Bottom latch 41 includes a mid-section 114 arranged to interconnect base 110 and latch lug 112 and formed to include a first slot 115 defining the arcuate first drive pin receiver and receiving drive tip 132 of first drive pin 130 as shown best in FIG. 4. Mid-section 114 includes a protruding portion 116 arranged to bifurcate first slot 115 to provide a latch-locking lobe channel 117 at one end of first slot 115 receiving drive tip 132 of first drive pin 130 upon movement of pin slider 90 in a first direction 45 toward rack 18 to cause drive tip 132 to assume the latch-locking position and to provide a latch-releasing lobe channel 118 at an opposite end of first slot 115 receiving drive tip 132 of first drive pin 130 upon movement of pin slider 90 in an opposite second direction 46 away from rack 18 to cause drive tip 132 to assume the latch-releasing position. As shown in FIG. 10, a reference line 100 extends through first latch pivot axis 85 and latch lug 112 and is sized and located in mid-section 114 to cause drive tip 132 of first drive pin 130 to lie at a first distance 101 from reference line 100 upon movement of drive tip 132 into latch-releasing lobe channel 118 as shown in FIG. 13 and to lie at a greater second distance 102 from reference line 100 upon movement of drive tip 132 into latch-locking lobe channel 117 as shown in FIG. 15.

Top latch 42 includes a mid-section 124 arranged to interconnect base 120 and latch lug 122 and formed to include a second slot 125 defining the arcuate second drive pin receiver and receiving drive tip 232 of second drive pin 230 as shown best in FIG. 4. Mid-section 124 includes a protruding portion 226 arranged to bifurcate second slot 125 to provide a latch-locking lobe channel 127 at one end of second slot 125 receiving drive tip 232 of second drive pin 230 upon movement of pin slider 90 in a first direction 45 toward rack 18 to cause drive tip 230 to assume the latch-locking position and to provide a latch-releasing lobe channel 128 at an opposite end of second slot 125 receiving drive tip 232 of second drive pin 230 upon movement of pin slider 90 in an opposite second direction 46 away from rack 18 to cause drive tip 232 to assume the latch-releasing position.

Pin slider 90 is mounted to slide in a space between latch mount 52 of mount unit 36 and bottom and top latches 41, 42 as suggested in FIGS. 4–6. Pin slider 90 includes a slide plate 91 and a push tab 92. Slide plate 91 is formed to include a first guide slot 93 receiving first pivot mount 80 therein to allow movement of pin slider 90 relative to first pivot mount 80 as first drive pin 30 is moved back and forth between the latch-locking and latch-releasing positions. Slide plate 81 is also formed to include a second guide slot 94 receiving second pivot mount 82 therein to allow movement of pin slider 90 relative to second pivot mount 82 as second drive pin 230 is moved back and forth between the latch-locking and latch-releasing positions.

Slide plate 91 is arranged to move in a first direction 45 toward rack 18 to cause first and second drive pins 130, 230 to move to assume the latch-locking positions and in an opposite second direction 46 away from rack 18 to cause first and second drive pins 130, 230 to move to assume the latch-releasing positions as suggested in FIG. 9. Push tab 92 is coupled to slide plate 91 and arranged to extend away from load-carrying slide 26 when load-carrying slide 26 has been moved to assume the retracted position. Push tab 92 is arranged to lie in spaced-apart relation to rack 18 to locate bottom and top latches 41, 42 therebetween when bottom and top latches 41, 42 are mated to rack 18 as shown, for example, in FIG. 10.

Latch mount 52 of mount unit 36 is formed to include a pin head receiver channel 53. Each drive pin 130, 230 includes a pin head 131, 132 arranged to move in pin head receiver channel 53 during movement of slide plate 91 relative to mount unit 36 and a drive tip 131, 231 arranged to extend into one of the arcuate first and second drive pin receivers 115, 125.

As suggested in FIGS. 4 and 8–10, a pin slider 90 is formed to include a first guide slot 93 receiving and allowing sliding movement of first pivot mount 80 therein and a second guide slot 94 receiving and allowing sliding movement of second pivot mount 82 therein. First drive pin 130 is coupled to pin slider 90 and bottom latch 41 and arranged to pivot bottom latch 41 about first pivot axis 85 in response to sliding movement of pin slider 90 relative to first pivot mount 80. Second drive pin 230 is coupled to pin slider 90 and top latch 42 and arranged to pivot top latch 42 about second pivot axis 87 in response to sliding movement of pin slider 90 relative to second pivot mount 82.

Neck 133 of first drive pin 130 extends through a first aperture 98 formed in slide plate 91 as suggested in FIG. 4. Likewise, neck 233 of second drive pin 230 extends through a second aperture 99 formed in slide plate 91.

A first drive pin retainer 134 is mounted on first drive pin 130 and is arranged to lie in first aperture 98 for movement with slide plate 91 as suggested in FIGS. 4 and 12–15. First drive pin retainer 134 is ring-shaped in the illustrated embodiment. First drive pin retainer 134 is made of a resilient, deformable material to be compressed n a space 135 between first drive pin 130 and a first inner edge of slide plate 91 defining first aperture 98 (as shown in FIGS. 14 and 15). Such compression takes place upon movement of first drive pin 130 to the latch-locking position to create a first "locking action" to retain bottom latch 41 in the spaced-apart position.

A washer 136 is mounted on neck 133 of first drive pin 130 and arranged to lie between ring-shaped first drive pin retainer 134 and base 110 of bottom latch 41. This locates ring-shaped first drive pin retainer 134 between pin head 131 and washer 136. Washer 136 is used to "contain" the "O-ring" first drive pin retainer 134 and eliminate protrusion of that retainer 134 into arcuate slot 115.

A second drive pin retainer 234 is mounted on second drive pin 230 and is arranged to lie in second aperture 99 for movement with slide plate 91 as suggested in FIG. 4. Second drive pin retainer 234 is ring-shaped in the illustrated embodiment. Second drive pin retainer 234 is made of a resilient, deformable material to be compressed in a space between second drive pin 230 and a second inner edge of slide plate 91 defining second aperture 99. Such compression takes place upon movement of second drive pin 230 to the latch-locking position to create a second "locking action" to retain top latch 42 in the spaced-apart position.

A washer 236 is mounted on neck 233 of second drive pin 230 and arranged to lie between ring-shaped second drive pin 234 and base 120 of top latch 42. This locates ring-shaped second drive pin retainer 234 between pin head 231 and washer 236. Washer 236 is used to contain the O-ring second drive pin retainer 234 and eliminate protrusion of that retainer 234 into arcuate slot 125.

Each of first and second drive pin receiver slots 115, 125 is defined by a curved border edge to move each of first and second drive pins 130, 230 along an arcuate path as pin slider 90 slides relative to first and second pivot mounts 80, 82 as suggested in FIGS. 4–6 and 8–10. As suggested, for example, in FIG. 8, curved border edges are shaped to establish a first center of curvature 201 for the arcuate path associated with first drive pin 130 and a second center of curvature 202 for the arcuate path associated with second drive pin 230. First and second drive pin receiver slots 115, 125 are arranged to lie in a space located between first and second centers of curvature 201, 202.

As disclosed herein, pin slider 90 "holds" two O-ring-shaped drive pin retainers 134, 234 and two "centering" drive-pins 130, 230 in "pockets" defined by apertures 98, 99 and in banana-shaped slots 115, 125 formed in bottom and top latches 41, 42. Pivot mounts 80, 82 are coupled to bottom and top latches 41, 42 and arranged to slide in straight slots 93, 94 formed in pin slider 90. Pivot mounts 80, 82 are also coupled to latch mount 52 and function to guide the motion of pin slider 90. Mount unit 36 is formed to include a cavity 53 that is large enough to hold and allow sliding motion of the large ends 131, 231 of drive pins 130, 230 and two holes 84, 86 for fixing the pivot mounts 80, 82.

As pin slider 90 is moved forward in direction 45, straight slots 93, 94 cause pin slider 90 to move forward in a perpendicular fashion toward rack 18. Simultaneously, bottom and top latches 41, 42 pivot about pivot axes 85, 87 and are pushed outward (opposing each other) by drive pins 130, 230 riding in the banana-shaped arcuate slots 115, 125. This motion continues forward until an "over-center" location is reached in the forward end 117, 227 of the banana-shaped arcuate slot 115, 125. As pin slider 90 reaches this forward-most, over-center position, each O-ring spring (e.g., first and second drive pin retainers 134, 234) is compressed on the inside wall of the round openings 98, 99 formed in pin slider 90 creating the locking action.

Bottom latch 41 is coupled to mount unit 36 and arranged to extend through first slot 63 formed in rack mount 54 and first channel 65 formed in first alignment guide 64 and through the first (23) of the series of latch apertures formed in rack 18 to block uncoupling of the quick-mount support 11 and rack 18 as shown in FIG. 10. Top latch 42 is coupled to mount unit 36 and arranged to extend through second slot 68 formed in rack mount 54 and second channel 70 formed in second alignment guide 69, and through the second (25) of the series of latch apertures to block uncoupling of quick-mount support 11 and 18 as shown in FIG. 10.

Use of a quick-mount support 11 to couple a stationary slide 30 of a telescoping slide assembly 16 to a rack 18 to assume a fixed position (of the type shown in FIGS. 1–3) is shown in FIGS. 8–10 with reference also to FIGS. 5 and 6. Prior to coupling, bottom latch 41 is pivoted to a "raised and unlocked" position and top latch 42 is pivoted to a "lowered and unlocked" position shown in FIGS. 5, 8, and 9. In this "drawn-together" position, latch lug 112 of bottom latch 41 is "poised" to be passed in direction 45 through latch aperture 23 of rack 18 along with first alignment guide 64. Also, latch lug 122 of top latch 42 is "poised" to be passed in direction 45 through latch aperture 25 of rack 18 along with second alignment guide 69.

Next, quick-mount support 11 and stationary slide 30 are moved as a unit in direction 45 toward rack 18 as shown in FIG. 9. Such movement causes rack mount 54 to abut rearwardly facing surface 22 of rack 18, first alignment guide 64 and latch lug 112 to pass as a unit through latch aperture 23 in rack 18, and second alignment guide 69 and latch lug 122 to pass as a unit through latch aperture 25.

Then, latch mover 44 is moved relative to retainer mount 52 in direction 45 to pivot bottom latch 41 in counterclockwise direction 96 and to pivot top latch 42 in clockwise direction 95. This causes bottom latch 41 to be moved to assume a "lowered and locked" position to cause a portion of latch lug 112 to extend to block removal of latch lug 112 from latch aperture 23. This also causes top latch 42 to be moved to assume a "raised and locked" position to cause a portion of latch lug 122 to extend to block removal of latch lug 122 from latch aperture 25. In this "spread-apart" position, stationary slide 30 is held in a fixed position relative to rack 18 provided in cabinet 10.

What is claimed is:

1. A telescoping slide assembly support system comprising a telescoping slide assembly including load-carrying and stationary slides movable relative to one another to extend and retract the load-carrying slide relative to the stationary slide between fully extended and retracted positions;

a rack formed to include a series of latch apertures, and a quick-mount support coupled to the stationary slide, the quick-mount support including a movable bottom latch arranged to extend through a first of the latch apertures and configured to include an arcuate first drive pin receiver, a movable top latch arranged to extend through a second of the latch apertures and configured to include an arcuate second drive pin receiver, and a latch mover including a first drive pin arranged to move relative to the bottom latch in the arcuate first drive pin receiver, a second drive pin arranged to move relative to the top latch in the arcuate second drive pin receiver, and a pin slider, the first and second drive pins being coupled to the pin slider to move therewith relative to the bottom and top latches, the pin slider being mounted to move relative to the bottom and top latches to cause the first drive pin to move in the arcuate first drive pin receiver and the second drive pin to move in the arcuate second drive pin receiver between latch-locking positions wherein the first and second drive pins move the bottom and top latches away from one another to a spread-apart position to mate the bottom and top latches with the rack to block uncoupling of the quick-mount support and the rack and latch-releasing positions wherein the first and second drive pins move the bottom and top latches toward one another to a drawn-together position to unmate the bottom and top latches from the rack to allow uncoupling of the quick-mount support and the rack.

2. The system of claim 1, wherein the bottom latch is mounted for movement about a first latch pivot axis, the bottom latch includes a first base intersecting the first latch pivot axis, a first latch lug arranged to extend through the first of the latch apertures, and a first mid-section arranged to interconnect the first base and the first latch lug and formed to include a first slot defining the arcuate first drive pin receiver and receiving a drive tip of the first drive pin.

3. The system of claim 2, wherein the first mid-section includes a protruding portion arranged to bifurcate the first slot to provide a latch-locking lobe channel at one end of the first slot receiving the drive tip of the first drive pin upon movement of the pin slider in a first direction toward the rack to cause the drive tip to assume the latch-locking position and to provide a latch-releasing lobe channel at an opposite end of the first slot receiving the drive tip of the first drive pin upon movement of the pin slider in an opposite second direction away from the rack to cause the drive tip to assume the latch-releasing position.

4. The system of claim 3, wherein a reference line extends through the first latch pivot axis and the latch lug and the slot is sized and located in the mid-section to cause the drive tip of the first drive pin to lie at a first distance from the reference line upon movement of the drive tip into the latch-releasing lobe channel and to lie at a greater second distance from the reference line upon movement of the drive tip into the latch-locking lobe channel.

5. The system of claim 2, wherein the top latch is mounted for movement about a second latch pivot axis, the top latch includes a second base intersecting the second latch pivot axis, a second latch lug arranged to extend through the second of the latch apertures, and a second mid-section arranged to interconnect the second base and the second latch lug and formed to include a second slot defining the arcuate second drive pin receiver and receiving a drive tip of the second drive pin, the second mid-section includes a protruding portion arranged to bifurcate the second slot to provide a latch-locking lobe channel at one end of the second slot receiving the drive tip of the second drive pin upon movement of the pin slider in a first direction toward the rack to cause the drive tip to assume the latch-locking position and to provide a latch-releasing lobe channel at an opposite end of the second slot receiving the drive tip of the second drive pin upon movement of the pin slider in an opposite second direction away from the rack to cause the drive tip to assume the latch-releasing position.

6. The system of claim 2, wherein the first base is formed to include a first pivot aperture, the quick-mount support further includes a mount unit and first pivot mount arranged to extend through the first pivot aperture and coupled to the mount unit to establish the first latch pivot axis, and the pin slider is mounted to slide in a space between the mount unit and the bottom latch and is formed to include a first guide slot receiving the first pivot mount therein to allow movement of the pin slider relative to the first pivot mount as the first drive pin is moved back and forth between the latch-locking and latch-releasing positions.

7. The system of claim 6, wherein the first drive pin further includes a pin head and a neck interconnecting the pin head and the drive tip and extending through a first aperture formed in the pin slider, the quick-mount support further includes a deformable first drive pin retainer mounted on the neck and arranged to lie in the first aperture, and a portion of the first drive pin retainer is compressed in a space between the neck and an inner edge of the pin slider defining the first aperture upon movement of the first drive pin to the latch-locking position to create a locking action to retain the bottom latch in the spread-apart position.

8. The system of claim 6, wherein the first drive pin extends through a first aperture formed in the pin slider and the quick-mount support further includes a ring-shaped first drive pin retainer mounted on the first drive pin and arranged to lie in the first aperture to abut the pin slider.

9. The system of claim 8, wherein the first drive pin further includes a pin head and a neck extending through the first aperture between the pin head and the drive tip and carrying the ring-shaped first drive pin retainer and the latch mover further includes a washer mounted on the neck and arranged to lie between the ring-shaped first drive pin retainer and the first base of the bottom latch to locate the ring-shaped first drive pin retainer between the pin head and the washer.

10. The system of claim 1, wherein the pin slider includes a slide plate arranged to move in a space between the stationary slide and the bottom and top latches in a first direction toward the rack to cause the first and second drive pins to move to assume the latch-locking positions and in an opposite second direction away from the rack to cause the first and second drive pins to move to assume the latch-releasing positions.

11. The system of claim 10, wherein the pin slider further includes a push tab coupled to the slide plate and arranged to extend away from the load-carrying slide when the load-carrying slide has been moved to assume the retracted position and wherein the push tab is arranged to lie in spaced-apart relation to the rack to locate the bottom and top latches therebetween when the bottom and top latches are mated to the rack.

12. The system of claim 10, wherein the first drive pin extends through a first aperture formed in the slide plate, the second drive pin extends through a second aperture formed in the slide plate, and the quick-mount support further includes a first drive pin retainer mounted on the first drive pin and arranged to lie in the first aperture for movement with the slide plate and a second drive pin retainer mounted on the second drive pin and arranged to lie in the second aperture for movement with the slide plate.

13. The system of claim 12, wherein each of the first and second drive pin retainers is ring-shaped, the first drive pin retainer is made of a deformable material to be compressed in a space between the first drive pin and a first inner edge of the slide plate defining the first aperture upon movement of the first drive pin to the latch-locking position to create a first locking action to retain the bottom latch in the spread-apart position, and the second drive pin retainer is made of a deformable material to be compressed in a space between the second drive pin and a second inner edge of the slide plate defining the second aperture upon movement of the second drive pin to the latch-locking position to create a second locking action to retain the top latch in the spread-apart position.

14. The system of claim 12, wherein each of the first and second drive pin retainers is ring-shaped.

15. The system of claim 12, wherein the first drive pin further includes a pin head, a drive tip, and a neck extending through the first aperture between the pin head and the drive tip and carrying the ring-shaped first drive pin retainer and the latch mover further includes a washer mounted on the neck and arranged to lie between the ring-shaped first drive pin retainer and a first base of the bottom latch to locate the ring-shaped first drive pin retainer between the pin head and the washer.

16. The system of claim 10, wherein the first drive pin extends through a first aperture formed in the slide plate, the second drive pin extends through a second aperture formed in the slide plate, the quick-mount support further includes a mount unit coupled to the stationary slide and formed to include a pin head receiver channel, and each drive pin includes a pin head arranged to move in the pin head receiver channel during movement of the slide plate relative to the mount unit and a drive tip arranged to extend into one of the arcuate first and second drive pin receivers.

17. The system of claim 16, wherein each drive pin further includes a neck interconnecting the drive head and the drive tip and a deformable ring-shaped drive pin retainer mounted on the neck.

18. The system of claim 16, wherein the quick-mount support further includes a first pivot mount coupled to the bottom latch and to the mount unit to support the bottom latch for pivotable movement relative to the mount unit about a first pivot axis and arranged to extend through a first guide slot formed in the slide plate and a second pivot mount coupled to the top latch and to the mount unit to support the top latch for pivotable movement relative to the mount unit about a second pivot axis and arranged to extend through a second guide slot formed in the slide plate.

19. The system of claim 10, wherein the quick-mount support unit further includes a mount unit coupled to the stationary slide and arranged to lie in spaced-apart relation to the bottom and top latches to locate the slide plate therebetween, and the quick-mount support further includes a first pivot mount coupled to the bottom latch and to the mount unit to support the bottom latch for pivotable movement relative to the mount unit about a first pivot axis and arranged to extend through a first guide slot formed in the slide plate and a second pivot mount coupled to the top latch and to the mount unit to support the top latch for pivotable movement relative to the mount unit about a second pivot axis and arranged to extend through a second guide slot formed in the slide plate.

20. A telescoping slide assembly support system comprising a telescoping slide assembly including load-carrying and stationary slides movable relative to one another to extend and retract the load-carrying slide relative to the stationary slide between fully extended and retracted positions, a rack formed to include a series of latch apertures, and a quick-mount support including a latch mount coupled to the stationary slide, a bottom latch arranged to extend into a first of the latch apertures, a first pivot mount coupled to the bottom latch and to the latch mount to support the bottom latch for pivotable movement relative to the latch mount about a first pivot axis, a top latch arranged to extend into a second of the latch apertures, a second pivot mount coupled to the top latch and to the latch mount to support the top latch for pivotable movement relative to the latch mount about a second pivot axis, and a latch mover mounted for movement relative to the bottom and top latches, the latch mover including a pin slider formed to include a first guide slot receiving and allowing sliding movement of the first pivot mount therein and a second guide slot receiving and allowing sliding movement of the second pivot mount therein, a first drive pin coupled to the pin slider and the bottom latch and arranged to pivot the bottom latch about the first pivot axis in response to sliding movement of the pin slider relative to the first pivot mount, and a second drive pin coupled to the pin slider and the top latch and arranged to pivot the top latch about the second pivot axis in response to sliding movement of the pin slider relative to the second pivot mount.

21. The system of claim 20, wherein the bottom latch is formed to include a first drive pin receiver slot, the first drive pin is arranged to extend into the first drive pin receiver slot and move therein in response to sliding movement of the pin slider relative to the first pivot mount, the top latch is formed to include a second drive pin receiver slot, and the second drive pin is arranged to extend into the second drive pin receiver slot and move therein in response to sliding movement of the pin slider relative to the second pivot mount.

22. The system of claim 21, wherein each of the first and second drive pin receiver slots is defined by a curved border edge to move each of the first and second drive pins along an arcuate path as the pin slider slides relative to the first and second pivot mounts.

23. The system of claim 22, wherein the curved border edges are shaped to establish a first center of curvature for the arcuate path associated with the first drive pin and a second center of curvature for the arcuate path associated with the second drive pin and the first and second drive pin receiver slots are arranged to lie in a space located between the first and second centers of curvature.

24. The system of claim 20, wherein the pin slider includes a slide plate arranged to move in a space between the latch mount and the bottom and top latches in a first direction toward the rack to cause the first and second drive pins to pivot the bottom and top latches away from one another to a spread-apart position to mate the bottom and top latches with the rack to block uncoupling of the quick-mount support and the rack and in an opposite second direction away from the rack to cause the first and second drive pins to pivot the bottom and top latches toward one another to a drawn-together position to unmate the bottom and top latches from the rack to allow uncoupling of the quick-mount support and the rack.

25. The system of claim 24, wherein the slide plate is formed to include the first and second guide slots.

26. The system of claim 24, wherein the pin slider further includes a push tab coupled to the slide plate and arranged to extend away from the load-carrying slide when the load-carrying slide has been moved to assume the retracted position and wherein the push tab is arranged to lie in spaced-apart relation to the rack to locate the bottom and top latches therebetween when the bottom and top latches are mated to the rack.

27. The system of claim 24, wherein the first drive pin extends through a first aperture formed in the slide plate, the second drive pin extends through a second aperture formed in the slide plate, and the quick-mount support further includes a first drive pin retainer mounted on the first drive pin and arranged to lie in the first aperture for movement with the slide plate and a second drive pin retainer mounted on the second drive pin and arranged to lie in the second aperture for movement with the slide plate.

28. The system of claim 27, wherein each of the first and second drive pin retainers is ring-shaped.

29. The system of claim 20, wherein the first drive pin extends through a first aperture formed in the pin slider, the second drive pin extends through a second aperture formed in the pin slider, the latch mount is formed to include a pin head receiver channel, and each drive pin includes a pin head arranged to move in the pin head receiver channel during sliding movement of the pin slider relative to the slide base second pivot mount.

30. A telescoping slide assembly support system comprising a telescoping slide assembly including load-carrying and stationary slides movable relative to one another to extend and retract the load-carrying slides relative to the stationary slide between fully extended and retracted positions, a rack formed to include a series of latch apertures, and a quick-mount support including a bottom latch mounted to pivot relative to the stationary slide about a first pivot axis and arranged to extend into a first of the latch apertures formed in the rack, a top latch mounted to pivot relative to the stationary slide about a second pivot axis and arranged to extend into a second of the latch apertures formed in the rack, and means for selectively pivoting the bottom and top latches about the first and second pivot axis away from one another to assume a spread-apart position to mate the bottom and top latches with the rack to block uncoupling of the quick-mount support and the rack and toward one another to assume a drawn-together position to unmate the bottom and top latches away from the rack to allow uncoupling of the quick-mount support and the rack.

* * * * *